United States Patent [19]

Partridge

[11] Patent Number: 4,662,501

[45] Date of Patent: May 5, 1987

[54] COIN CHECKING

[75] Inventor: David Partridge, West Wickham, England

[73] Assignee: Starpoint Electrics Limited, England

[21] Appl. No.: 668,851

[22] Filed: Nov. 6, 1984

[30] Foreign Application Priority Data

Jan. 3, 1984 [GB] United Kingdom ..... 8400046

[51] Int. Cl.[4] ..... G07F 3/02

[52] U.S. Cl. ..... 194/319; 194/344; 194/345

[58] Field of Search ..... 194/1 C, 1 K, 97 R, 194/100 A, 100 R, 102, 103, 317, 319, 344, 345

[56] References Cited

U.S. PATENT DOCUMENTS 2,129,512 9/1938 Wallin ..... 194/101

4,374,557 2/1983 Sugimoto ..... 194/100 A

FOREIGN PATENT DOCUMENTS 2455112 11/1974 Fed. Rep. of Germany ... 194/100 A

*Primary Examiner*—Robert J. Spar

*Assistant Examiner*—P. McCoy Smith

*Attorney, Agent, or Firm*—Larson and Taylor

[57] ABSTRACT

The invention relates to a coin acceptor mechanism in which a coil (101) is wound on a former (102) having a central opening (104) of a shape corresponding to the outline of a coin (103) to be checked and mounted with the plane of the opening at an angle to the horizontal. The opening (104) has, towards its lower side, a cross member (106) located below the transverse center line of the coil (101) so that a coin (**103*b*) can momentarily rest on the cross member with its plane in the plane of the coil and can then turn about the cross member under its own weight and pass edge-wise through the opening in the former. A coin guide (110) guides coins edge-wise in a generally vertical direction towards the lower side of the coil so that a coin emerging from the guide enters the part of the opening (107) in the former (102) on the side of the cross member (106) away from the diameter and then turns about the cross member into the plane of the coil, at which point an output signal dependent on the characteristics of the coin as a whole is obtained. A lever (112**) is included for clearing jammed coins.

6 Claims, 3 Drawing Figures

COIN CHECKING

This invention relates to the checking of coins and, more generally, to coin accepting mechanisms which operate in accordance with the results of such checking. Such mechanisms are used, for example, on vending machines and amusement machines, and operate to accept genuine coins and reject the remainder. Rejected coins may be defective in one respect or another, or may be forgeries and it is important to have an accurate system of checking in order to ensure that such forgeries are rejected.

The great majority of modern coin checking arrangements operate electrically by passing the coin to be checked through an energised test coil and making use of the resultant inductive or eddy current effects or both. The result of passing a coin through the coil is to obtain some form of output signal indicative of the nature of the coin, and this may either be compared with a reference signal corresponding to the passage of a genuine coin or alternatively it may be fed directly to a micro-processor. A micro-processor is capable of discriminating between a number of different denominations of coin, any one of which may be acceptable, but many forms of accepting mechanism are designed for use with only a single denomination of coin and it is primarily with this type of mechanism that the present invention is concerned.

As mentioned above, the signal from the test coil may be compared with a reference signal and this may be derived from a reference coil which has an output effectively identical to that of the test coil, having a core formed either by a genuine coin or its equivalent. A particularly accurate way of obtaining signals from the two coins and comparing them so as to determine whether or not a coin is genuine is described in the co-pending application Ser. No. 591,580 U.S. Pat. No. 4,574,935 filed Mar. 20, 1984, the disclosure of which is incorporated herein by reference.

A coin will pass to the acceptance mechanism travelling edge first and the opening through the test coil is in the form of a slot permitting passage of the coin in this attitude. Consequently, when the test signal is generated, i.e. usually when the coin is at the mid-point of its travel through the coil and its diameter lies in the plane of the coil, the portion of the coin which influences the inductive and eddy current effects referred to above is represented by a slice across the diameter of the coin. Any possible defects or abnormalities in the remainder of the coin have little, if any, effect on the signal. This applies particularly to non-circular coins such as a fifty pence piece.

The present invention is based on the principle of passing the coin through the test coil on the flat, that is to say, with the opposite faces of the coin parallel with the plane of the coil, so that virtually the whole volume of the coin affects the output signal. For this purpose, in accordance with the invention, the coil is wound on a former having a central opening of a shape corresponding at least approximately to the outline of a coin to be checked and arranged for mounting with the plane of the opening at an angle to the horizontal, the opening in the former having, towards its lower side, a cross member located below the transverse centre line of the coil so that the coin can momentarily rest on the cross member with its plane in the plane of the coil and can then turn about the cross member under its own weight and pass edge-wise through the opening in the former. In addition the assembly includes a coin guide for guiding a coin edge-wise in a generally vertical direction towards the lower side of the coil so that a coin emerging edge-wise from the guide enters the part of the opening in the form on the side of the cross member away from the diameter and then turns about the cross member into the plane of the coil.

In other words, the coin approaches the test coil edge-wise in a generally vertical direction, engages the narrower part of the opening through the former, through which it cannot pass, turns about the cross member until it lies in the plane of the coil, at which time the test signal is generated, and then continues its turning movement until it is able to pass edge-wise through the wider part of the opening in the former, after which it continues its travel through the mechanism. The test signal thus generated can then be used in any of the different ways referred to previously. The arrangement can be used with any type of coin and is found to provide a considerably more accurate indication of the properties of many coins than with previous types of test coil.

In order to reduce any possible risk of a coin becoming jammed as it initially enters the narrower part of the opening through the former, this part of the opening, i.e. that on the side of the cross member away from the diameter, preferably has radiused corners where the cross member meets the circumference of the opening. The elimination of the relatively sharp-angled corners at these points reduces the risk of the edge of the coin becoming wedged. Despite this, there is still a residual risk of jamming which is more likely to occur with defective coins or forgeries. For this purpose, the cross member may be made movable so that if a jam occurs, it may be released by movement of the cross member. The release of any such jam may be made more effective by mounting the cross member on a pivoted lever which is so shaped that when it is turned about its pivot to move the cross member downwardly out of the opening a nose portion enters the opening at the top to clear any obstruction. Not only is the cross member moved out of the way, but any jammed coin or other form of obstruction is forced downwardly to clear the opening.

An assembly of test coil and coin guide in accordance with the invention forms one component of a complete acceptor mechanism, of which the other essential components are a power source for energising the coil, a circuit for detecting the response to the presence of a coin with its plane in the plane of the coil and for producing a corresponding output signal and means responsive to the output signal for accepting or rejecting the coin as it falls from the coil. The assembly must, of course, be so designed in relation to the other components as to be capable of being installed in the correct attitude, that is to say with the plane of the opening in the former at an angle to the horizontal and the coin guide substantially vertical. It is found in practice that best results are obtained when the plane of the opening is at an angle of approximately 30° to the horizontal, and the assembly needs to be designed to make this possible. The coin guide need not be strictly vertical, and provided it does not depart from the vertical by more than a few degrees, consistent results are obtainable.

An example of an assembly in accordance with the invention for use in an acceptor mechanism having the basic components just referred to, will now be described with reference to the accompanying drawings, in which.

Figure 1:
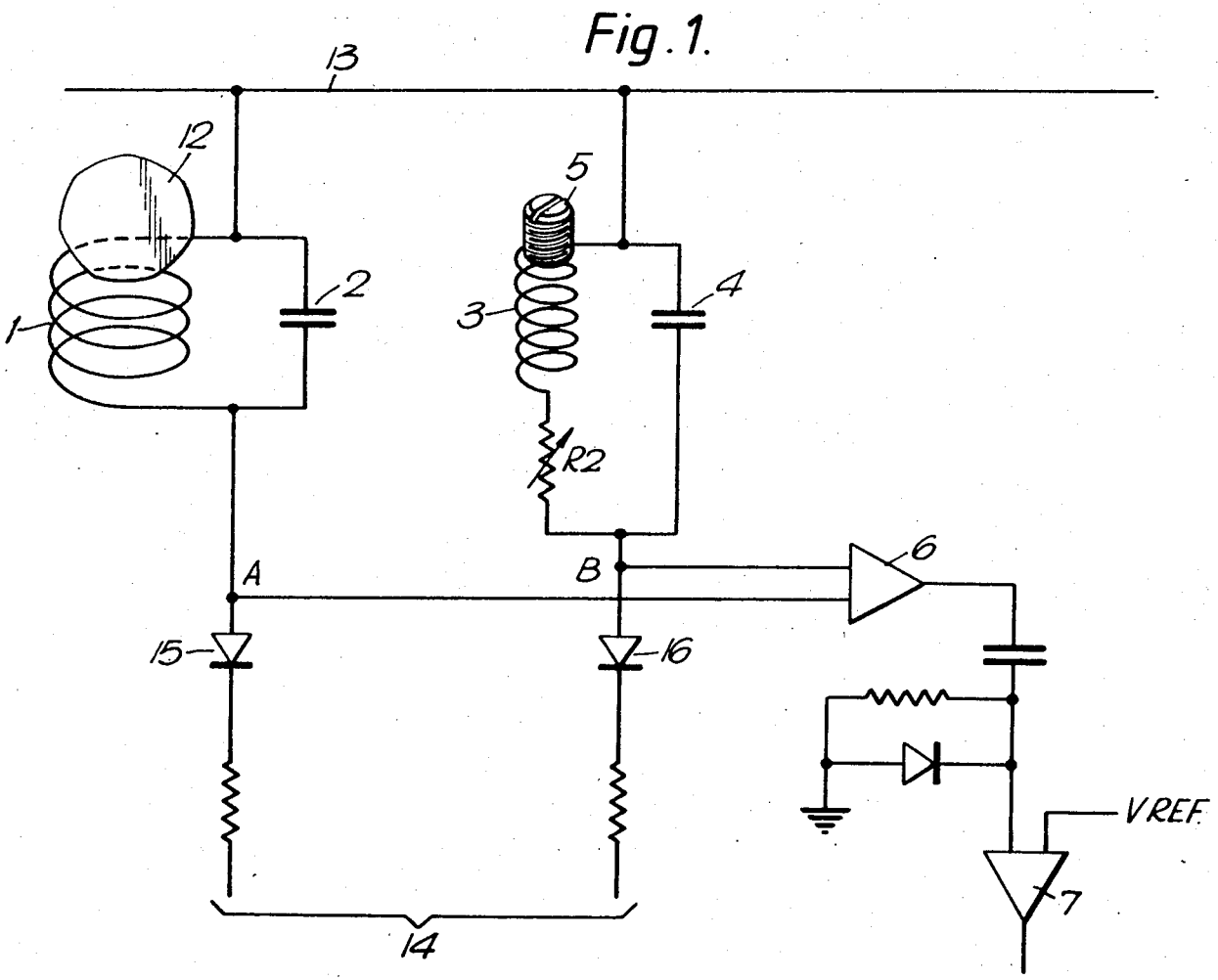
FIG. 1 is a schematic circuit diagram of the overall system in which the invention is incorporated.

Referring first to FIG. 1, the system illustrated therein corresponds to that disclosed in the above-mentioned U.S. Ser. No. 591,580, filed on Mar. 20, 1984, and is intended to check only a single denomination of coin, e.g. a fifty pence piece 12. A coil 1 is wound on a former which defines an appropriately shaped slot to receive the coin to be tested. The coil 1 is connected in parallel with a capacitor 2 between a rail 13 and a power interrupter 14 which is connected to the other side of the supply. A comparison coil 3 having an adjustable core 5 is connected in parallel with a capacitor 4 and in series with an adjustable resistor R2, between the rail 13 and the interrupter. Diodes 15 and 16 isolate the two parallel circuits.

When the interrupter 14 simultaneously interrupts the current through the coils 1 and 3, both coils will go free and the respective capacitors 2 and 4 will charge and discharge through their coils to produce a decaying train of voltage oscillations which will appear at points A and B respectively.

The signals at the points A and b are fed to a comparator device such as a differential amplifier 6, the output of which represents the difference between the two signals. This output is then fed to a further device such as a voltage comparator 7 which determines whether or not the output of the differential amplifier 6, i.e., the difference of the two signals at A and B, is above or below a predetermined datum value fixed by the setting of the voltage comparator. The voltage comparator will give an output or not depending on the magnitude of the signal from the differential amplifier, and provided the output is below the predetermined datum value, the output of the comparator 7 will allow the coin to pass down an acceptance path by removing a deflector (not shown). Unless this deflector is removed, the coin is automatically rejected.

At the time of initially setting up the equipment, a coin 12 is held at the mid-way position in the coil 1 and the core 5 and the resistor R2 are adjusted until the signals at the point A and B are substantially identical, thus leading to zero or very small output from the differential amplifier 6. As previously described, the presence of the cores in the coils 1 and 3 leads to an eddy current reaction when oscillatory current flows in the coil in question, thus giving rise to circuit losses and affecting the form of the decaying wave train which results when the current to the coil is interrupted. By equalizing the eddy current effects in the two coils, the two wave trains can be made virtually identical. If subsequently, however, an incorrect coin e.g., of a different mass, different material or different size from a genuine coin 12 is passed through the coil 1, the wave trains are no longer identical, an appreciable output results from the amplifier 6 and since no accept signal is produced by the comparator 7, the coin is rejected.

The frequency of the interrupter 14 is such that a number of successive comparisons are made as a coin through the coil 1, normally under conditions of free fall. As just described, the equipment is initially set up with a coin in the mid-way position so that zero output from the amplifier 6 is obtained instantaneously as a genuine coin passes through this mid-way position. An incorrect coin, e.g., a forgery, will not give zero output at the mid-way position, but may possible give zero output as it first enters the coil. If so, a corresponding zero reading will be given as the coin reaches the corresponding position when leaving the coil and by monitoring the time interval between these two zero output signals, they can be ignored and prevented from producing an accept signal. Other forms of forgery and other incorrect coins may produce no zero output signal at all and therefore do not lead to any problem.

Figure 2:
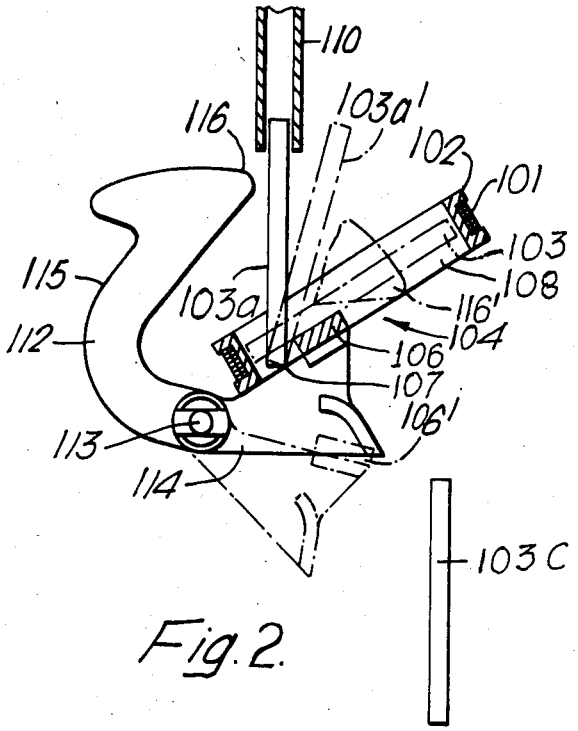
FIG. 2 is a sectional elevation showing a coin to be tested in successive positions as it passes through the assembly.
Figure 3:
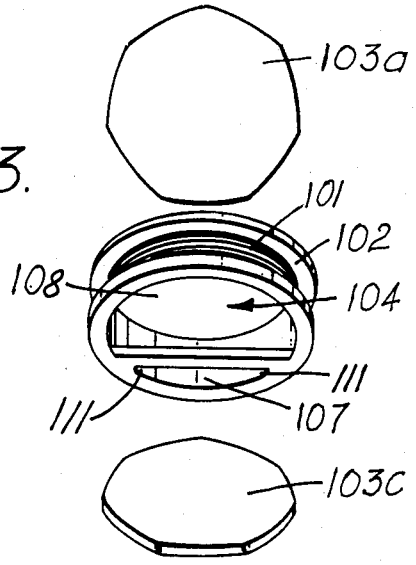
FIG. 3 is a side view of the coil seen in FIG. 2.

Turning to the present invention, as seen in both Figures , a test coil 1 01, corresponding to coil 1 as discussed above, is wound on a former 102 which has a central opening (seen in FIG. 3) of a shape corresponding to the outline of the particular denomination of coin to be checked, in the example a fifty pence piece. This coin is sevensided, each side having a slight curvature as seen at 103 in FIG. 3. The central opening 104 in the former 102 differs slightly from this in that it is circular and is slightly larger than the coin itself, so that the latter may pass freely through the opening. A cross member 106 having its lower surface level with that of the former 102 extends across the opening 104 so as to divide it into two unequal portions 107 and 108. As seen in FIG. 2, the former 102 is mounted for operation at an angle to the horizontal with the cross member 106 towards its lower side. The precise angle of inclination to the horizontal depends on the coin being checked and the dimensions of the former 102, but an angle in the region of 30° is found to be appropriate for most circumstances. In the example illustrated, the angle is 32°.

As already mentioned, the lower side of the cross member 106 is level with the lower side of the former 102 and the upper side of the member is just below the transverse centre line of the coil so that a coin resting momentarily on the cross member in the position indicated as **103*b* lies in the plane of the coil 101. This position is only momentarily because the centre of gravity of the coin lies to the right of the cross member 106 as seen in FIG. 2, and this causes the coin to turn in a clock-wise direction until it is substantially vertical, when it falls through the larger portion 118 of the opening 104 into the position shown as 103*c*. This is possible because the right hand side of the cross member 106 as seen in FIG. 2 is to the left of the corresponding diameter of the opening 104**, so that there is a clear passage for the coin along the diameter of the opening.

A coin is guided to the former 102 by a guide 10 which is illustrated in FIG. 2 as vertical. Strict verticality is not essential, however, and the guide may depart from the vertical by a few degrees, particularly in a clockwise direction where the departure may be up to about 15°. A coin just leaving the guide 110 in a vertical attitude. is shown as **103*a* and the corresponding position for a coin leaving a guide inclined to the vertical is shown in dotted lines as 103*a'***.

The guide 110 is so located in relation to the former 3 that the coin enters the narrower portion 107 of the opening 104 as seen in FIG. 2. The coin cannot pass through this relatively narrow space and instead pivots about the cross member 106 until it reaches the position **103*b* in the plane of the coil 10 as previously described. To reduce the risk of a coin (particularly a faulty or counterfeit coin) becoming jammed in the space 107, this space has radiused corners 111 where the cross member 106 meets the circumference of the opening. If, despite the presence of these radiuses, a jam occurs, this can be freed by means of a reject lever 112 which is pivoted at 113. The lever has one arm 114 which supports the cross member 106 and a second arm 115 shaped to define a nose portion 116. When the lever is turned in a clock-wise direction, the cross member 106 is lowered to the position shown in dotted lines as 106' to allow free passage through the opening 104 and, at the same time, the nose 116 enters the opening in the position shown in dotted lines as 106'** to clear the obstruction.

In operation, a coin to be checked approaches the coil 102 in the position 103*a* and then turns through slightly less than a right angle to the position 103*b* where the checking action occurs as the result of energisation of the coil 101 and production of an output signal indicative of the nature of the coin. As explained above, the position 103*b* is only momentary and the coin continues its turning movement until it reaches a generally vertical position when it falls through the larger space 108 in a generally vertical attitude, as shown at 103*c*.

The other components of the acceptor mechanism are not illustrated, but must, of course, be so designed that the former 102 and the guide 110 will occupy the relative positions shown.

I claim:

1. In a coin acceptor mechanism, a coin-checking assembly comprising a former, a coil wound on said former, said former having a central opening of a shape corresponding at least approximately to the circumferential outline of a coin to be checked, said former being arranged for mounting so that a central plane through the opening and the portions of the former which define said opening and perpendicular to the axis of the opening, is disposed at an angle to the horizontal with upper and lower sides of the coil being defined on opposite sides of said plane, the opening in said former having, towards the lower side of the coil, a cross member located below said central plane of said opening and disposed so as to divide said opening into a larger part and a smaller part such that a coin can momentarily rest on said cross member with its plane in the plane of said coil and can then turn about said cross member under its own weight and pass edge-wise through said opening in said former, said assembly also including a coin guide for guiding a coin edgewise in a generally vertical direction towards the lower side of said coil whereby a coin emerging edge-wise from said guide enters the part of said opening in said former on the side of said cross member away from the diameter and then turns about said cross member into the plane of said coil.

2. A coin-checking assembly according to claim 1 in which the smaller part of said opening in said former has radiused corners where said cross member meets the circumference of said opening.

3. A coin-checking assembly according to claim 1 in which the plane of said opening is arranged for mounting at an angle of approximately 30° to the horizontal.

4. A coin-checking assembly according to claim 1 including means mounting said cross member for downward movement whereby to release jams.

5. A coin-checking assembly according to claim 4 in which said mounting means comprises a lever, means for pivoting said lever in a central region thereof to define first and second arms, said first arm mounting said cross member for downward movement and said second arm being shaped to define a nose portion normally located above said opening in said former, whereby when said lever is turned about said pivot means to move said cross member downwardly said nose portion enters said opening from the normal location thereof above said opening.

6. A coin acceptor mechanism including a coin-checking assembly comprising a former, a coin wound on said former, said former having a central opening of a shape corresponding at least approximately to the circumferential outline of a coin to be checked, said former being arranged for mounting so that a central plane through the opening and the portions of the former which define the opening, and perpendicular to the axis of the opening, is disposed at an angle to the horizontal with upper and lower sides of the coil being defined on opposite sides of said plane, the opening in said former having, towards the lower side of the coil, a cross member located below said central plane and disposed so as to divide said opening into a larger part and a smaller part such that a coin can momentarily rest on said cross member with its plane in the plane of said coil and can then turn about said cross member under its own weight and pass edge-wise in a generally vertical direction towards the lower side of said coil whereby a coin emerging edge-wise from said guide enters the part of said opening in said former on the side of said cross member away from the diameter and then turns about said cross member into the plane of said coil, a power source for energizing said coil, and a circuit for detecting the response to the presence of a coin with its plane in the plane of said coil when said coil is energized and for producing a corresponding output signal used in controlling accepting or rejecting said coin as it falls from said coil.

* * * * *